US006561285B2

(12) United States Patent
Intonen et al.

(10) Patent No.: US 6,561,285 B2
(45) Date of Patent: May 13, 2003

(54) BREAKING APPARATUS AND TOOL

(75) Inventors: Juha Intonen, Lahti (FI); Ossi Kahra, Lahti (FI); Jari Korkeila, Lahti (FI); Ilkka Niemi, Lahti (FI); Timo Sippus, Hollola (FI)

(73) Assignee: Sandvik Tamrock Oy (FI)

( * ) Notice: Subject to any disclaimer, the term of this patent is extended or adjusted under 35 U.S.C. 154(b) by 0 days.

(21) Appl. No.: 09/971,678

(22) Filed: Oct. 9, 2001

(65) Prior Publication Data

US 2002/0040798 A1 Apr. 11, 2002

(30) Foreign Application Priority Data

Oct. 9, 2000 (FI) ..... 20002226

(51) Int. Cl.[7] ..... B25D 11/02
(52) U.S. Cl. ..... 173/211; 173/210; 173/212
(58) Field of Search ..... 173/166, 167, 173/210, 212, 162.1; 227/10, 130

(56) References Cited

U.S. PATENT DOCUMENTS

| | | | | | |
|---|---|---|---|---|---|
| 3,179,185 | A | * | 4/1965 | Wandel et al. | 173/133 |
| 3,496,840 | A | * | 2/1970 | Farrell | 173/210 |
| 3,661,216 | A | * | 5/1972 | Yamanaka | 173/138 |
| 4,336,848 | A | | 6/1982 | Wanner | |
| 4,609,135 | A | * | 9/1986 | Elliesen | 173/210 |
| 5,056,701 | A | * | 10/1991 | Bereiter | 173/210 |
| 5,558,264 | A | * | 9/1996 | Weinstein | 227/10 |
| 5,944,120 | A | * | 8/1999 | Barden | 173/135 |
| 6,032,847 | A | * | 3/2000 | Ehmig et al. | 173/211 |

FOREIGN PATENT DOCUMENTS

| | | |
|---|---|---|
| DE | 805 268 | 5/1951 |
| DE | 17 04 838 | 8/1955 |
| EP | 0 854 013 A1 | 7/1998 |

OTHER PUBLICATIONS

European Search Report dated Jan. 28, 2002.

* cited by examiner

*Primary Examiner*—Scott A. Smith
*Assistant Examiner*—Nathaniel Chukwurah
(74) *Attorney, Agent, or Firm*—Burns, Doane, Swecker & Mathis, L.L.P.

(57) ABSTRACT

A breaking apparatus, which comprises a percussion device (1), and in the extension thereof, a tool (3) to which a percussion piston (2) belonging to a percussion device delivers impacts. In the axial direction, the movement of the tool is limited by a stopper element (15) if the movement of the tool exceeds a predetermined range of movement (B) in the direction of the impact (A). The stopper element (15) is a piece made of elastic material, which is arranged in a space between the tool and a supporting surface (16). During the stopping of the tool, the capacity of the space for the stopper element reduces, whereby the element is subjected to pressing. By the effect of the tool movement, the stopper element thus rotates about its cross-sectional central axis (21) and at the same time changes its cross-sectional shape in the reducing space. The invention further relates to a tool used in the above-described breaking apparatus.

12 Claims, 4 Drawing Sheets

BREAKING APPARATUS AND TOOL

BACKGROUND

The invention relates to a breaking apparatus which comprises a percussion device and, in the axial extension thereof, a tool, the percussion device having a percussion piston that is arranged to make reciprocating movements in the axial direction and to strike a strike-receiving surface for providing an impact impulse in the tool, whereby the tool transmits the impact impulse further to a target to be broken, the breaking apparatus also comprises a tool stopper, by which the axial movement of the tool away from the percussion device is limited, the tool stopper comprising at least one stopper element of elastic material, whose cross section is substantially circular and whose cross-sectional central axis is transverse to the longitudinal axis of the tool, and in which breaking apparatus the stopper element is arranged in a space between the tool and a supporting surface, whereby, during the stopping of the tool, the mutual axial movement of the tool and the supporting surface is arranged to provide a volumetric change in said space for the stopper element.

The invention further relates to a tool for the breaking apparatus, which tool is to be arranged in an axial extension of the percussion device in the breaking apparatus, the tool comprising a strike-receiving surface which a percussion piston of the percussion device is arranged to strike so as to provide an impact impulse in the tool, which is arranged to transmit the impact impulse further to a target to be broken, and the breaking apparatus comprises a tool stopper, by which the axial movement of the tool away from the percussion device is limited, whereby at least one stopper element of elastic material is arranged in a space between the tool and the supporting surface, whereby, during the stopping of the tool, the mutual axial movement of the tool and the supporting surface is arranged to provide a volumetric change in said space for the stopper element.

Breaking apparatuses, i.e. percussion hammers, are used for breaking stone, concrete, asphalt, frozen ground, metal slag and other relatively hard materials. Conventionally, the percussion hammers are mounted in place of excavator buckets, and consequently they are operated by excavator hydraulics. Other base machines and mounting frames can be used as well. The breaking apparatus comprises a percussion device, to which a tool is attached. When the apparatus is in operation, a percussion piston of the percussion device moves to and fro by the action of pressure medium, strikes a strike-receiving surface of the tool and provides an impact impulse in the tool. The tool is simultaneously pressed against the target to be broken, whereby the tool penetrates, by the effect of the impact, into the material to be treated and makes the material break or cut, depending on the shape of the tool.

The tool is arranged in the percussion hammer such that, during the use, it can move to and fro for a predetermined distance in the impact direction of the percussion piston. In connection with the tool, there is a so-called tool stopper which holds the tool attached to the percussion device such that the tool cannot fall freely off the percussion hammer, for instance, when the breaking apparatus is transferred and when the tool is not supported against the target. Conventionally the tool stopping is arranged such that longitudinal, elongated grooves are provided on the outer surface of the tool shaft, on the opposite sides thereof. Alternatively, an elongated opening is provided in the tool. The percussion hammer body comprises, in turn, transverse support openings at said grooves or openings and a stopper bolt is inserted in the transverse direction through the support openings in the body and the grooves in the tool. The movement of the stopper bolt is then prevented with respect to the body, but thanks to the grooves, the tool can move in the percussion piston's direction of movement for a distance limited by the length of the grooves.

When the target is suddenly broken under the tool, or when the tool otherwise penetrates into the material to be broken faster than predicted, for instance in soft stone, a so-called idle stroke is produced. When the idle stroke takes place, the tool is not sufficiently supported to the target to be treated so as to transmit forces produced by the impact impulse to the target to be treated in a normal manner, but the tool must receive the impact mainly by means of the stopper mechanism of the tool. In a conventional stopper solution, in which a groove, an opening or a corresponding stopping surface provided in the tool strikes against the transverse stopper bolts, the stopping is rigid. There is metal against metal in the contacting surface between the tool and the stopper bolts. The tool is stopped at a short distance and consequently the structure of the percussion hammer is subjected to heavy stresses. For instance, binding bolts, with which various blocks of the percussion hammer are generally assembled, are subjected to heavy loads resulting from stopping forces. One solution attempts to damp the stresses resulting from the stopping of the tool by supporting the stopper bolt elastically to the body of the percussion hammer. In that case, when stopping the tool, the stopper bolt can shift for a predetermined distance in the direction of the impact supported by springs or corresponding means. However, these solutions have a disadvantage that the structure is complicated and expensive.

Further, stopper mechanisms based on the use of elastic material have been developed. In one solution, a conventionally mounted stopper bolt consists of two metallic halves, between which there is elastic material to damp the stopping forces. However, in case of a idle stroke it is difficult to provide sufficient damping with an elastic stopper bolt of this kind. In addition, the structure is expensive and difficult to manufacture. For instance, from DE publication 805,268 is still known a bushing, made of an elastic material, which is arranged to be immovable in a circular space provided in a lower end of the percussion device, to encircle the upper end of the tool. The tool then comprises a shoulder, by which the movement of the tool is limited in the direction of the impact. When the tool protrudes over the usual operating range outwardly from the percussion hammer, for instance in case of a idle stroke, the shoulder starts pressing the stop bushing in the radial direction. The circular space for the stop bushing in the body is designed capacious as compared with the volume of the bushing, so that the bushing can change its shape in the circular space as pressed by the shoulder. In one solution, a separate chamber, in which a bushing-like ring of elastic material encircles the tool, is arranged at a lower end of the percussion hammer. The bushing is supported to the chamber only on the outer circumference. The tool shaft has a shoulder by which shearing/pressing stress is caused to the elastic ring. This has a drawback that the chamber at the lower end of the percussion hammer increases the length of the percussion hammer. Hence, the tool must be longer, which may cause problems in supporting the tool. Apart from the longitudinal direction, the arrangement of shearing/pressing type requires a considerable space around the tool as well, and as a consequence, the solution increases the total outer dimensions of the percussion hammer, which makes the apparatus difficult to operate.

BRIEF DESCRIPTION OF THE INVENTION

The object of the present invention is to provide a novel and improved arrangement for stopping a tool of a breaking apparatus.

The breaking apparatus according to the invention is characterized in that a stopper element is a substantially circular piece in cross-section, that the cross-sectional central axis of the stopper element is transverse to the longitudinal axis of the tool, and that when stopping the tool the stopper element is arranged to rotate about its said central axis and to move in the direction of the impact of the percussion device, and while rotating to change its cross-sectional shape in a space with reducing capacity.

The tool according to the invention is characterized in that the upper part of the tool comprises a bushing-like guide part, whereby the tool and the percussion device can be partly nested, that the upper part of the tool comprises a shoulder portion that widens in the radial direction of the tool, the shoulder portion being arranged to affect the stopper element having a substantially circular cross section, which stopper element is arranged in a space between the tool and the supporting surface, and whose cross-sectional central axis is transverse to the longitudinal axis of the tool, and that when stopping the tool said shoulder portion of the tool is arranged to make the stopper element rotate about its cross-sectional central axis and make the tool move in the axial direction and further provide a change in the cross-sectional shape of the element.

The basic idea of the invention is that the movement of the tool in the percussion hammer is limited in the direction of the impact by means of a stopper element made of elastic material. The stopper element is arranged in a space between the tool and a suitably designed supporting surface. When mounted into place, the cross-sectional central axis of the stopper element is transverse to the longitudinal axis of the tool. The supporting surface is further supported substantially immovably to the percussion hammer body or a housing. The cross-section of the stopper element is substantially circular, whereby the element is arranged to revolve about its cross-sectional central axis in the space limited by the tool and the supporting surface when stopping the movement of the tool. Thanks to revolving, the stopper element wears less than in known solutions, wherefore it has a longer service life. The stopper element is preferably a loop, and consequently the space provided for it is ring-shaped. Technically, rotationally symmetrical shapes are less demanding and less expensive to manufacture.

While the stopper element rotates, it changes its cross-sectional shape. The surfaces of the space for the stopper element are designed oblique in the direction of the impact. Thus, the tool exceeding the normal range of operation provides a reduction in the capacity of said space. Advantageously, the oblique surfaces are suitably designed such that a change in the cross-sectional shape of the stopper element and the resulting force that resists the movement of the impact of the tool increase progressively in proportion to the length of travel of the tool, when the tool has exceeded the determined, normal range of operation. The forces resulting from a idle stroke are thus received in a guidelable manner, and the stopping distance is long, up to ten times longer than the stopping distance provided by rigid stopper bolts of metal. The loads, which result from the stopping and to which the structure of the percussion hammer is subjected, thus remain substantially lower. Despite the fact that the stopping distance of the invention is substantially longer than in previous solutions, the rotating stopper element takes clearly less space than the known solutions.

The contacting surface between the stopper element having a substantially circular cross-section and the tool/supporting surface is line-shaped, but when the stopper element flattens under a load, the contact surface becomes larger. The heavier the load, the larger the contact surface is. Thus the adaptable stopper element balances surface pressures on counterparts. Thanks to the above-mentioned facts, the forces, to which the structure of the percussion hammer is subjected on stopping the tool, are lower than previously and they are in better guide, and consequently the percussion hammer need not be designed so sturdy and massive. Therefore, the structure can be lighter and less expensive to manufacture. In addition, it is easier to handle this kind of percussion hammer. The design and selection of the material of the stopper element, and further the design of the tool shoulder and the supporting surface, allow to affect the stopping of the tool and the damping of the stopping forces in a relatively simple manner. The stopper element is a simple wearing piece, which is inexpensive to manufacture and easy to change.

Further, the basic idea of a preferred embodiment of the invention is that the tool and the supporting surface are designed such that at the end of the stopping event the space for the stopper element is substantially closed. The elastic stopper element thus substantially adapts to the shape of said closing space by the effect of a compressive force. When the stopper element is of elastic material, such as rubber, which is substantially incompressible, the tool cannot move on any further and it finally stops in this extreme position.

According to a second preferred embodiment of the invention there is a bushing-like guide portion at the upper end of the tool. The tool and the lower end of the percussion device are partly nested. The upper end of the tool is large in diameter, and therefore the contacting surface between the stopper element and the tool, and correspondingly between the stopper element and the supporting surface can be large. The tool can also be shorter and sturdier than before.

In a third preferred embodiment of the invention, the supporting surface is provided in a lower part of the housing, on the inner surface thereof. A shoulder having an oblique surface is provided in the upper part of the tool. In this construction, the stopper element is arranged in a space between the tool and the supporting surface provided in the housing. The housing thus protects the percussion hammer well against bumps and impurities. If necessary, the stopper element can also serve as a seal between the tool and the housing.

The basic idea of a fourth preferred embodiment is that the upper end of the tool is bushing-like and it extends round the lower part of the percussion device. The supporting surface is provided in the percussion device body, and a groove is provided correspondingly in the upper part of the tool, whereby the stopper element is arranged in a space between the percussion device body and the tool.

Further, the basic idea of a fifth preferred embodiment is that the lower part of the housing extends below the front end of the percussion device. The supporting surface and the stopper element are then located in the front end of the housing, the guide bushing of the tool being above them. The oblique surface between the tool shaft and the bushing-like portion presses the stopper element against the supporting surface as the tool is stopped.

BRIEF DESCRIPTION OF THE DRAWINGS

The invention will be described in greater detail in the attached drawings, wherein.

DETAILED DESCRIPTION OF THE INVENTION

Figures 1A, 1B, 1C:
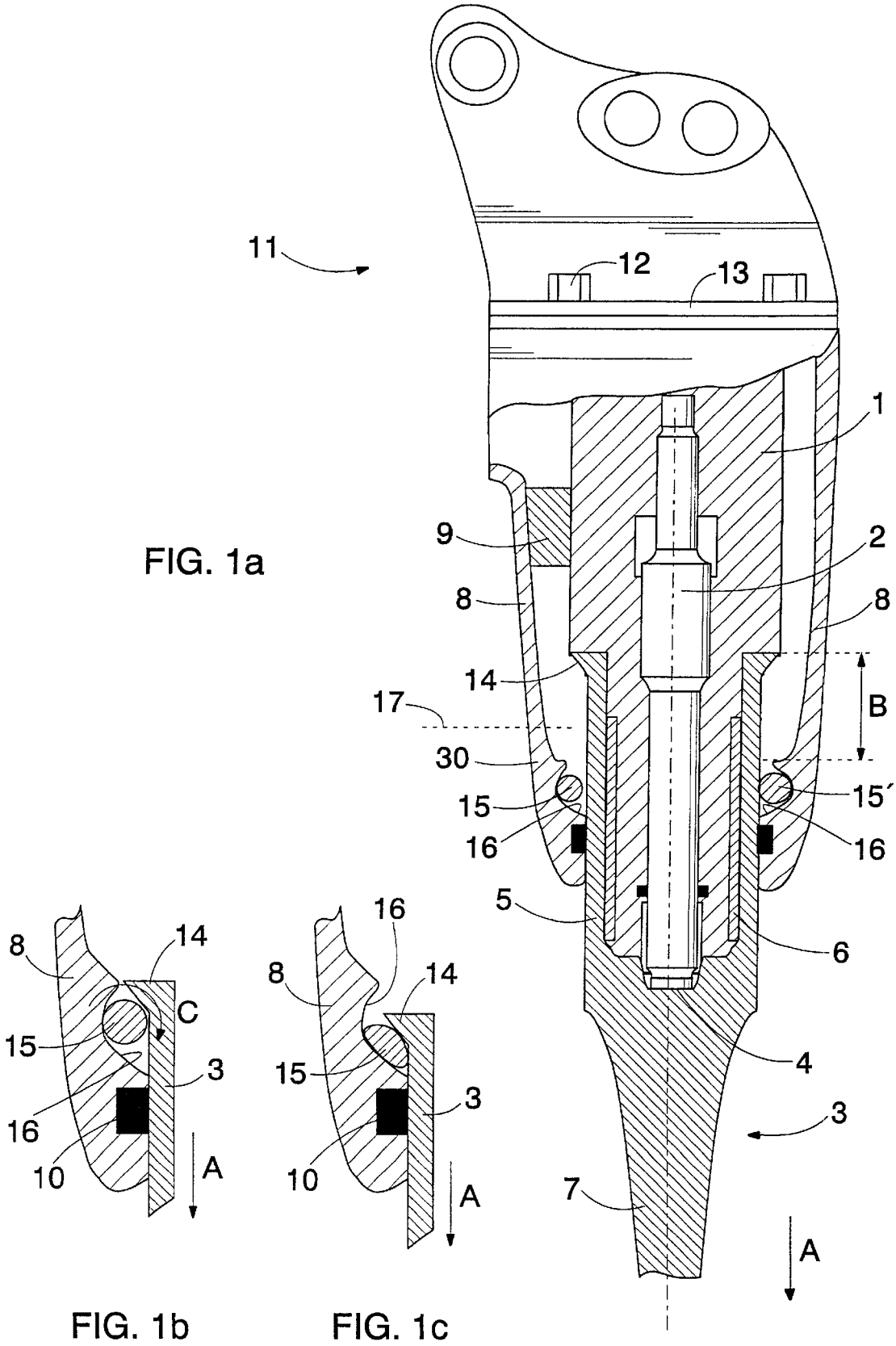
FIG. 1*a* is a schematic side view of a percussion hammer of the invention, partly cut open.
FIGS. 1*b* and 1*c* are enlarged details of the percussion hammer of FIG. 1*a* in different tool positions.

The reference numerals in the figures correspond to one another.

FIG. 1*a* shows a percussion hammer of the invention in a simplified manner. Inside a percussion device 1 there is a percussion piston 2 which moves to and fro in the axial direction when the apparatus is in operation. The percussion piston is, in general, moved by pressure of a hydraulic fluid, but pneumatic and electrical drives are also possible. The structure and operation of the percussion device are known per se to the person skilled in the art, and therefore they are not described herein in greater detail. In the direction of an impact A an extension of the percussion device, i.e. the forepart of the percussion device, comprises a tool 3 having a strike-receiving surface 4 which the forepart of the percussion piston strikes. It should be noted that in the present document that the lower end and the forepart of the percussion hammer refer to the device end on the side of the tool. In this implementation, at the upper end of the tool there is a bushing-like guide part 5, which extends for a predetermined distance round the forepart of the percussion device 1. Because the tool and the percussion device are partly nested, the whole they form can be considerably shorter and sturdier than in conventional solutions. Between the percussion device and the guide part 5 of the tool there is a bushing 6, which allows the tool to slide with respect to the percussion device. Generally, the bushing is arranged exactly as in the figure, in connection with the percussion device, but as will appear from FIG. 3, the bushing can alternatively be arranged in a housing or in the tool. The bushing is made of a suitable slide bearing material, such as plastic or bearing metal, which need not be lubricated continuously. It is clear that the tool shaft 7 and its outermost end can be designed and dimensioned in a manner that suits best each particular application. Round the percussion device is also arranged a housing 8 that protects the percussion device against impurities and bumps. Between the housing and the percussion device there may be damping elements 9 for damping noise and vibration. Between the lower end of the housing and the tool there is a seal 10 which prevents impurities from getting into the housing. In the upper end of the breaking apparatus there is a securing part 11 having securing openings or the like means for securing the breaking apparatus to an excavator or the like. The percussion device and the housing are attached with screw means 12 to a flange 13 of the securing part. The apparatus is assembled such that the percussion device is attached to the securing part, whereafter the tool is fitted into place, and finally, the housing is conducted from beneath round the percussion device and secured to the securing part.

Figure 4A:
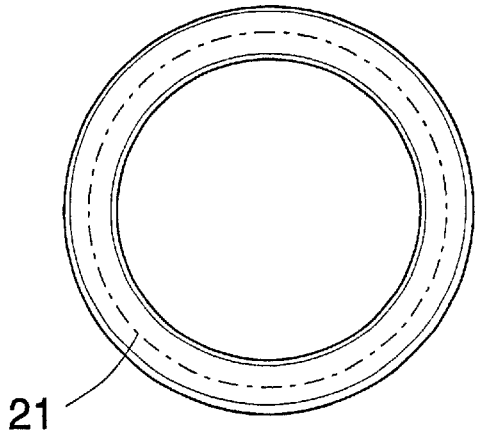
FIGS. 4*a* to 6 are schematic views of stopper elements of the invention.
Figure 5:
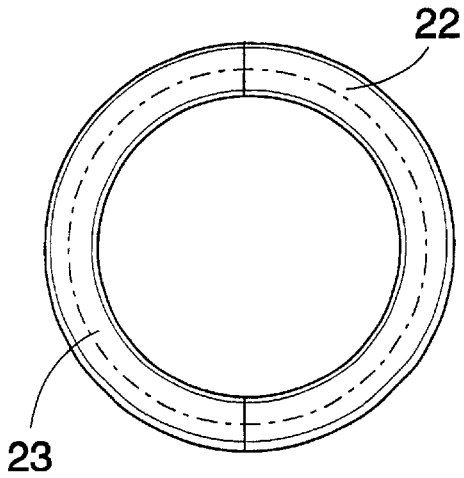

In the solution according to the figure, the tool stopper arrangement comprises a shoulder portion 14 provided in the upper part of the tool and widening obliquely outwards in the radial direction, a stopper element 15 and a supporting surface 16 for the stopper element. As appears from the figure, the stopper element is arranged in a suitably designed space between the tool and a housing 8. In this embodiment, the supporting surface 16 is provided on the inner surface of the housing, above a seal 10. The stopper element 15 is a piece made of elastic material, such as rubber, plastic or a compound thereof, which advantageously encircles the upper end of the tool. The construction does not have conventional, transverse through holes for stopper bolts, but the construction is tight and strong. In the present document, the elastic material generally refers to material whose shape adapts to a pressing force and which substantially returns back to its original shape after exertion of the force. The elastic material can be substantially incompressible or compressible. The stopper element is advantageously a closed ring, as in FIGS. 4*a* and 4*b*, which is cast, for instance. The element can just as well be a bar of a given length, which is bent into a loop to fit into a space between the tool and the supporting surface. In the latter case, a long preform bar can be cut into a bar or several bars of a suitable size, as in FIG. 5, and the stopper element is formed of these bars. The stopper element is preferably a circle in cross-section. The cross-section can also be ovoid or polygonal to some extent, with the proviso that when stopping the tool the stopper element can rotate about its cross-sectional central axis as will be described later on in the text. When the stopper element is substantially arranged only to rotate, and not to slide notably, while being under a load, the stopper element is prevented from wearing.

During normal breakage, the operating target receives the impact impulses caused to the tool, whereby the tool only moves for a limited distance in the direction of the impact A. The mutual position of the shoulder in the tool 14 and the stopper element is designed such that during a normal striking operation the shoulder does not come into contact with the stopper element, but the tool moves substantially freely with respect to the stopper element, guided by a bearing bushing 6. FIG. 1*a* shows this situation.

FIGS. 1*b* and 1*c* show some details of the tool stopper arrangement, when the tool has shifted in the direction of the impact A outwardly, exceeding the allowed movement range B, for instance as a result of a so-called idle stroke. Said idle stroke may take place, when the tool is not sufficiently supported to the target and impacts are delivered, however. In the situation of FIG. 1*b*, the tool shoulder 14 has shifted to the stopper element 15, and consequently the wedged surface of the shoulder starts pressing the stopper element 15 against the supporting surface 16. Because friction force is then produced between the stopper element and the tool, the stopper element starts rotating about its cross-sectional central axis in the direction C, and at the same time it proceeds with the tool in the direction of the impact A. Further, because the lower part of the supporting surface 16 is made oblique, the stopper element has to change its shape all the time during the rotation in a space with reducing capacity between the tool and the supporting surface. The rotation and the change in the shape of the stopper element requires energy, and as a consequence the outward movement of the tool starts gradually slowing down. FIG. 1*c* shows the tool in its lower position, in which the space between the tool and the supporting surface is substantially closed, and the stopper element can no longer rotate, nor change its shape. Finally, the movement of the tool stops in this position. When breakage is continued normally after a idle stroke, the percussion hammer is again pressed against the target, and the tool moves to a planned impact point. The supporting surface is further designed such that the elastic stopper element returns to its original shape and is able to return to its normal position.

In the solution of FIG. 1*a*, the stopper element 15' can also serve as a seal between the housing and the tool, when it is suitably designed. In that case no separate seal 10 is necessarily needed.

Figure 2A:
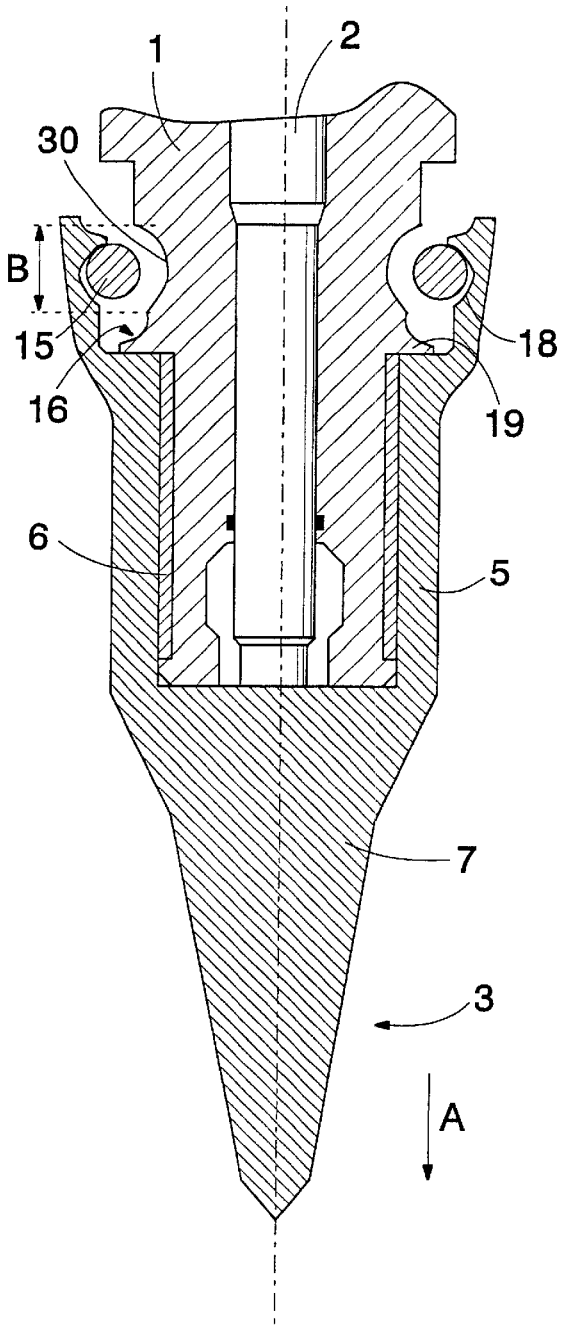
FIG. 2*a* is a schematic side view of a part of a second percussion hammer of the invention, cut open.
Figure 2B:
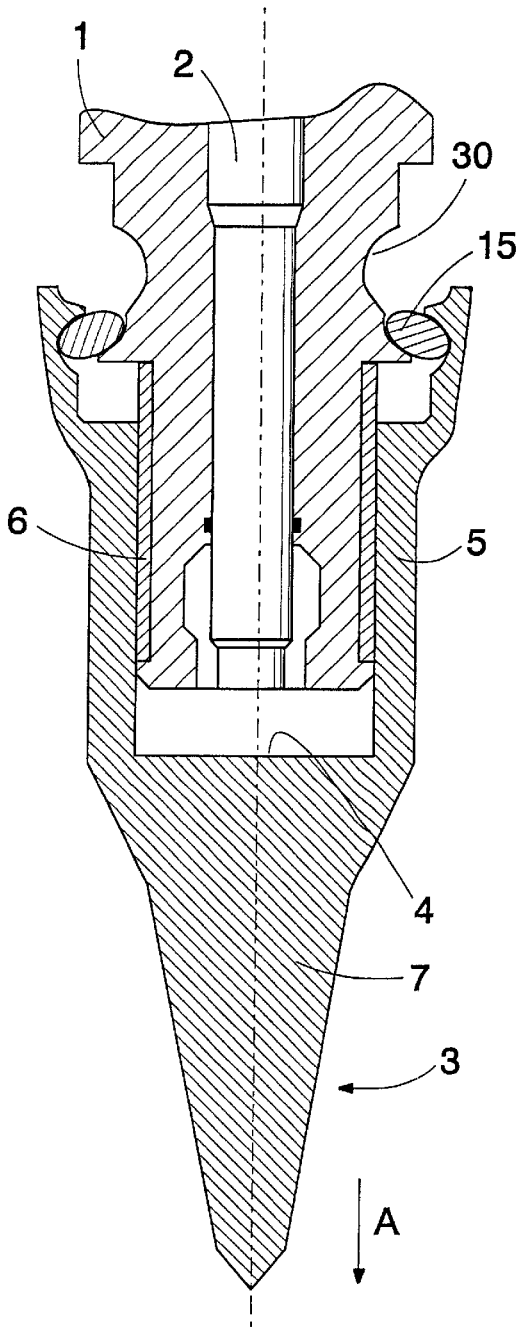
FIG. 2*b* shows the same percussion hammer in a situation, where the tool's movement in the direction of the impact is stopped.

FIGS. 2*a* and 2*b* show a part of another construction. In FIG. 2*a*, the tool is in a normal working situation, and correspondingly FIG. 2*b*, shows the stopping of the tool according to the principle of the invention, when the tool has exceeded the allowed range of movement B in the axial direction. In this construction, after mounting the tool, the stopper element 15 encircling the tool is conducted into a groove 18 designed for this purpose inside the upper part of the tool guide bushing 5. A mounting indent 30 is provided on the outer surface of the percussion device body for conducting the stopper element into place. A supporting surface 16 is also provided on the outer surface of the body of the percussion device 1. The stopper element is located in a ring-shaped space limited by the groove 18 and the mounting indent 30. The ring-shaped space is designed such that in normal operation the tool can move undisturbed by the stopper element. In the radial direction the supporting surface has an outwardly-projecting shoulder 19, against which the stopper element presses, when the tool exceeds its normal range of movement B. FIG. 2*b* shows this situation. The stopper element has rotated about its axis and shifted downwards against the shoulder 19. By the effect of the oblique surface of the shoulder the element is at the same time flattened. The rotation of the stopper element and the change in the cross-sectional shape damp the forces caused by the stopping of the tool. This structure is applicable to e.g. percussion hammers without housing.

Figure 3:
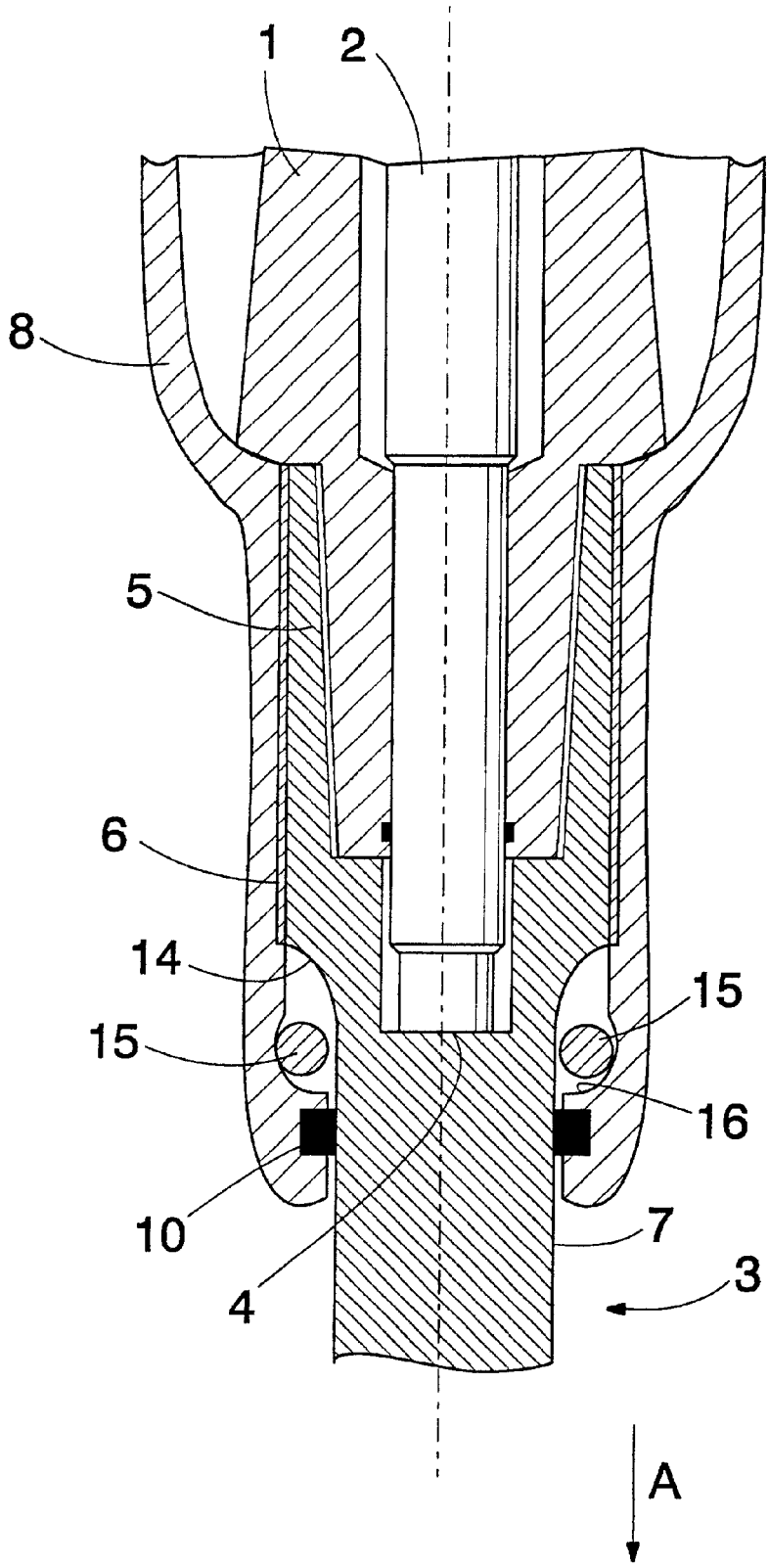
FIG. 3 is a schematic side view of a part of a third percussion hammer of the invention, cut open.

In the apparatus according to FIG. 3, the housing 8 extends below the forepart of the percussion device 1, and consequently the guide bushing 5 is completely inside the housing. The bearing bushing 6 is arranged between the housing and the tool. The stopper element 15 is located in a ring-shaped space between the supporting surface 16 provided in the lower part of the housing 8 and the shaft 7 of the tool. The supporting surface is designed in a suitable manner. When the tool is stopped, the oblique shoulder 14 between the guide bushing 5 and the shaft 7 presses the stopper element 15 and makes it rotate about its cross-sectional central axis, whereby the element moves in the direction of the impact and finally rests against the oblique surface of the lower part of the supporting surface. At the same time, the element changes its cross-sectional shape by the action of the pressing forces to which it is subjected.

Figure 4B:
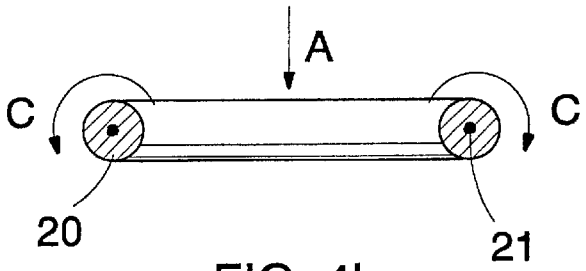
Figure 6:
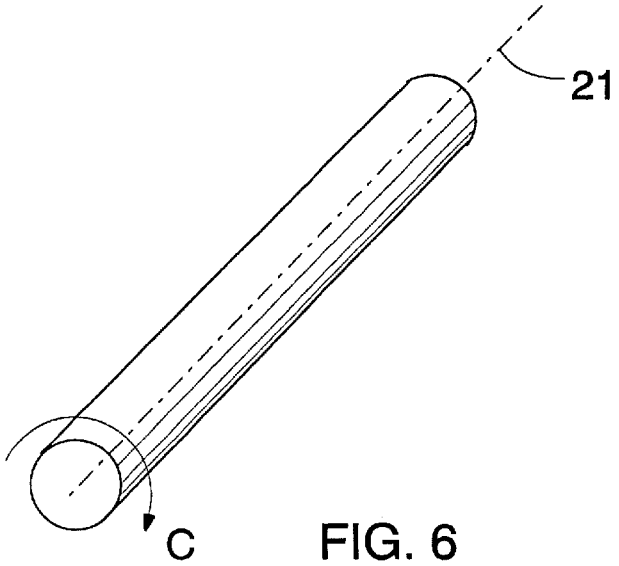

FIG. 4 shows a stopper element 15 of the invention seen from the direction of the impact and FIG. 4*b* shows the cross section of the corresponding element seen from the side of the breaking apparatus. Said stopper element is a closed ring, its cross section 20 is substantially circular, and further, its cross-sectional central axis 21 is transverse to the direction of the impact A in the percussion hammer. As appears from FIG. 5, the stopper element can also consist of one or more separate elongated bars 22 and 23, which are bent such that they form a continuous ring, or when necessary, there can be a gap between the bent bars. Alternatively, straight bars according to FIG. 6 can be used as stopper elements according to the invention, when they need not encircle the tool. In that case the bar-shaped stopper elements are arranged in transverse openings, the openings being elongated in the direction of the impact.

The stopper solutions of FIGS. 1*a* to 5 permit the tool to turn during the breakage. If it is desired that the position of the tool remains unchanged with respect to the percussion device, for instance when formed chisel bits are used, the stopper element and the space for the stopper element can be designed other than rotationally symmetrical, for instance ovoid, whereby the tool is prevented from turning about its longitudinal axis during the breakage. In addition, the turning can be prevented by designing the guide surface of the tool and the counterpart in the percussion device or in the housing to be fitted against the tool, for instance ovoid or polygonal, whereby the forces produced by turning will not stress the stopper element.

The drawings and the relating specification are only intended to illustrate the inventive idea. The details of the invention may vary within the scope of the claims. So, unlike in the figures there may be a plurality of stopper elements, and they may be arranged in different cross-sectional levels with respect to one another in the direction of the impact, either as rings surrounding the tool or as straight, transverse bars. In that case, a specific supporting surface is provided for each stopper element and the tool has a shoulder at a suitable place. The forepart of the breaking apparatus can be a detachable, changeable unit. Previously this has not been possible, because the stopping forces and the loading exerted on the structure have been considerable. To illustrate this, a broken line 17 in FIG. 1*a* indicates a joint between the detachable portion and the rest of the housing 8. The detachable forepart 30 comprises the supporting surface 16 of the stopper element, the stopper element 15 mounted into place and also the seal 10. The forepart that is battered and worn in use can then be readily replaced by a new forepart. The stopper element and the seal get also changed at the same time. One advantage of the solution is also that by detaching the forepart it is possible to perform the necessary service and repair operations, as well as a change of the tool and the bearing bushing thereof, readily without having to disassemble the rest of the structure. Further, in the solution of FIG. 2*a* the supporting surface 16 can be provided e.g. in a separate bushing or a corresponding piece, which is supported to the body of the percussion device 1. Finally, it should be noted that the invention can also be applied to other tools than those illustrated in the drawings of this document.

What is claimed is:

1. A breaking apparatus which comprises a percussion device and, in an axial extension thereof, a tool, the percussion device having a percussion piston that is arranged to make reciprocating movements in an axial direction and to strike a strike-receiving surface of the tool for providing an impact impulse in the tool, whereby the tool is adapted to transmit the impact impulse to a target to be broken, a tool stopper arranged to limit axial movement of the tool away from the percussion device, the tool stopper comprising at least one stopper element of elastic material, the stopper element having substantially circular cross section, and wherein a centerline of the stopper element is disposed in a plane perpendicular to the longitudinal axis of the tool, and the stopper element being arranged in a space between the tool and a supporting surface, and wherein, during the stopping of the tool, relative axial movement of the tool and the supporting surface results in a volumetric change in the space for the stopper element, and wherein the stopper element rotates about its centerline and moves in a direction of axial movement of the tool and, while rotating, the cross-sectional shape of the stopper element changes as a volume of the space reduces.

2. A breaking apparatus as claimed in claim 1, wherein, during stopping of the tool, the volume of the space reduces substantially at an end of axial movement of the tool, and the stopper element adapts substantially to the shape of the space.

3. A breaking apparatus as claimed in claim 1, wherein the stopper element is made of substantially incompressible elastic material.

4. A breaking apparatus as claimed in claim 3, wherein the stopper element is made of at least one of rubber and plastic.

5. A breaking apparatus as claimed in claim 1, wherein the stopper element is a closed ring.

6. A breaking apparatus as claimed in claim 1, wherein the stopper element includes one or more elongated pieces which are bent to form a ring.

7. A breaking apparatus as claimed in claim 1, wherein the tool includes a guide part and the percussion device is at least partially received in the guide part.

8. A breaking apparatus as claimed in claim 7, wherein the breaking apparatus includes a housing inside of which the percussion device and the tool are at least partially disposed, the housing extends below a forepart of the percussion device and the guide part of the tool, the supporting surface is provided on an inner surface of the housing, and a portion of the tool between the guide part and a tip of the tool defines a shoulder surface that defines an oblique angle with the direction of axial movement and which presses the stopper element when the tool is stopped.

9. A breaking apparatus as claimed in claim 1, wherein the breaking apparatus includes a housing inside of which the percussion device and the tool are at least partially disposed, the supporting surface is provided on an inner surface of a part of the housing, a shoulder extends radially outwardly from the tool and defines a surface that is oblique to the direction of axial movement, and wherein, after the tool has exceeded a predetermined range of movement in the direction of axial movement, the oblique surface of the shoulder is arranged to press the stopper element and, together with the supporting surface, make the stopper element rotate about its centerline and further change its cross-sectional shape.

10. A breaking apparatus as claimed in claim 9, wherein the stopper element is ring-shaped and seals the housing and the tool.

11. A breaking apparatus which comprises a percussion device and, in an axial extension thereof, a tool, the percussion device having a percussion piston that is arranged to make reciprocating movements in an axial direction and to strike a strike-receiving surface of the tool for providing an impact impulse in the tool, whereby the tool is adapted to transmit the impact impulse to a target to be broken, a tool stopper arranged to limit axial movement of the tool away from the percussion device, the tool stopper comprising at least one stopper element of elastic material, the stopper element having substantially circular cross section, and wherein a centerline of the stopper element is disposed in a plane perpendicular to the longitudinal axis of the tool, and the stopper element being arranged in a space between the tool and a supporting surface, and wherein, during the stopping of the tool, relative axial movement of the tool and the supporting surface results in a volumetric change in the space for the stopper element, and wherein the stopper element rotates about its centerline and moves in a direction of impact of the percussion device and, while rotating, the cross-sectional shape of the stopper element changes as a volume of the space reduces, wherein a groove is provided in an inner surface of the guide portion, the supporting surface is provided on an outer surface of the percussion device, the tool and the percussion device define the space, and the space is a ring-shaped space, the supporting surface includes a shoulder extending outwardly in a radial direction, and the stopper element is arranged to press against the shoulder as the tool is stopped, and the shoulder defines an oblique angle with the direction of axial movement.

12. A tool for a breaking apparatus, the tool being adapted to be arranged in an axial extension of a percussion device in the breaking apparatus, the tool comprising:

a strike-receiving surface adapted to be struck by a percussion piston of the percussion device so as to provide an impact impulse in the tool, the strike-receiving surface being adapted to transmit the impact impulse further to a target to be broken, and wherein the tool is adapted to cooperate with a tool stopper adapted to limit axial movement of the tool away from the percussion device, the tool stopper including at least one stopper element of elastic material, the stopper element being substantially circular in cross-section and having a centerline disposed in a plane perpendicular to a direction of axial movement, arranged in a space between the tool and a supporting surface, and, during the stopping of the tool, relative axial movement of the tool and the supporting surface causes a volumetric change in the space for the stopper element, an upper part of the tool including a guide part for at least partially receiving the percussion device, the upper part of the tool includes a shoulder portion, the shoulder portion being adapted to cause the stopper element to rotate about its centerline change a cross-sectional shape of the stopper element.

* * * * *